US006176689B1

(12) United States Patent
Bumbel et al.

(10) Patent No.: US 6,176,689 B1
(45) Date of Patent: Jan. 23, 2001

(54) ELECTRICALLY DRIVEN AIR PUMP

(75) Inventors: Andreasl Bumbel, Castrop-Rauxel; Rheinhard Debus, Meerbusch, both of (DE)

(73) Assignee: Pierburg AG, Neuss (DE)

( * ) Notice: Under 35 U.S.C. 154(b), the term of this patent shall be extended for 0 days.

(21) Appl. No.: 09/449,092

(22) Filed: Nov. 24, 1999

Related U.S. Application Data

(60) Provisional application No. 60/110,361, filed on Nov. 30, 1998.

(30) Foreign Application Priority Data

Nov. 27, 1998 (DE) ..... 198 54 747

(51) Int. Cl.[7] ..... F04B 39/00
(52) U.S. Cl. ..... 417/312
(58) Field of Search ..... 417/312, 313; 181/403

(56) References Cited

U.S. PATENT DOCUMENTS 5,875,562 * 3/1999 Fogarty ..... 34/97
6,036,434 * 3/2000 Ray et al. ..... 415/111
6,074,554 * 1/2000 Ray et al. ..... 210/194

FOREIGN PATENT DOCUMENTS 4438750 5/1996 (DE) .

* cited by examiner

*Primary Examiner*—Teresa Walberg
*Assistant Examiner*—Vinod D Patel
(74) *Attorney, Agent, or Firm*—Ladas and Parry

(57) ABSTRACT

An electrically driven air pump has a housing, in which an electric motor and a pump mechanism are arranged, the pump mechanism having at least one impeller with a multiple number of impeller channels. The housing has an annular channel, which connects to a discharge member. The annular channel is closed to the impeller channels by a cam disk which has a recess in its periphery to provide a defined opening for smooth passage of air from the impeller channels to the annular channel.

8 Claims, 2 Drawing Sheets

ELECTRICALLY DRIVEN AIR PUMP

This application claims the benefit of U.S. Provisional No. 60/110,361 filed Nov. 30, 1998.

FIELD OF THE INVENTION

The invention relates to an electrically driven air pump, for example, for motor vehicles.

BACKGROUND AND PRIOR ART

As described in DE 44 38 750 A1, there is a problem in such pumps in that they produce high operating noise, which is objectionable for the vehicle passengers. A principal reason for the high operating noise is the stimulation of the resonant frequency of the individual housing parts due to the pulsation transport of air.

SUMMARY OF THE INVENTION

An objection of the invention is to provide an electrically driven air pump, which has substantially reduced operating noise.

A further object of the invention is to provide an electrically driven air pump which substantially reduces the pulsation transport of the air.

In order to achieve the above and further objects, the invention provides an electrically driven air pump comprising a housing containing an electric motor and a pump mechanism driven by said electric motor. The pump mechanism includes an impeller having impeller channels which convey air outwardly to an annular channel for delivery of the air to a discharge connection member. A member closes flow of air from the impeller channels to said annular channel except for a defined opening through which controlled flow of air from the impeller channels to the annular channel takes place.

In this way, a defined introduction of the air flowing from an impeller channel into the annular channel is effected. The air does not pass outwardly in an impact-like manner from the air discharge member, but first flows through at least a portion of the annular channel. In this way, the transfer of air flow between two adjacent impeller channels occurs gently and free of pulsation and the desired air throughput can be controlled without further manipulations according to the user's requirements.

By providing the defined opening with special inlet and outlet profiles, a particularly gentle air flow passage is produced from the impeller channels to the annular channel.

A particularly simple embodiment is obtained by providing least one cam disk between the impeller channels and the annular channel and forming said defined opening as a recess in the periphery of the cam disk.

In this way, functional parameters such as pressure and throughput of conventional air pumps can be adapted in a simple and cost-favorable manner. If the cam disk is arranged in an adjustable, movable manner, it also offers the advantage that an adjustment of the pump parameters can be achieved by a displacement of the cam disk. Thus, for example, a displacement of the defined opening in the direction of the air discharge member produces a reduction in the delivery pressure. By a corresponding control of the cam disk, an adaptation of the pump parameters during use is also made possible. If two cam disks are used in a superimposed arrangement, it is additionally possible to vary the size and contour of the defined opening and thus vary the air throughput.

It has proven particularly advantageous is the length of the defined opening corresponds to between one and two times the width of an impeller channel. Together with the contour configuration, this provides for an optimal transport flow through the instantaneously active impeller channel as well as for a gentle passage to the following annular channel. In order to be able to utilize the annular channel in a fully effective manner as a diffuser, the annular channel has a progressively increasing cross-section in the air flow direction to the discharge member.

DETAILED DESCRIPTION

Figure 1:
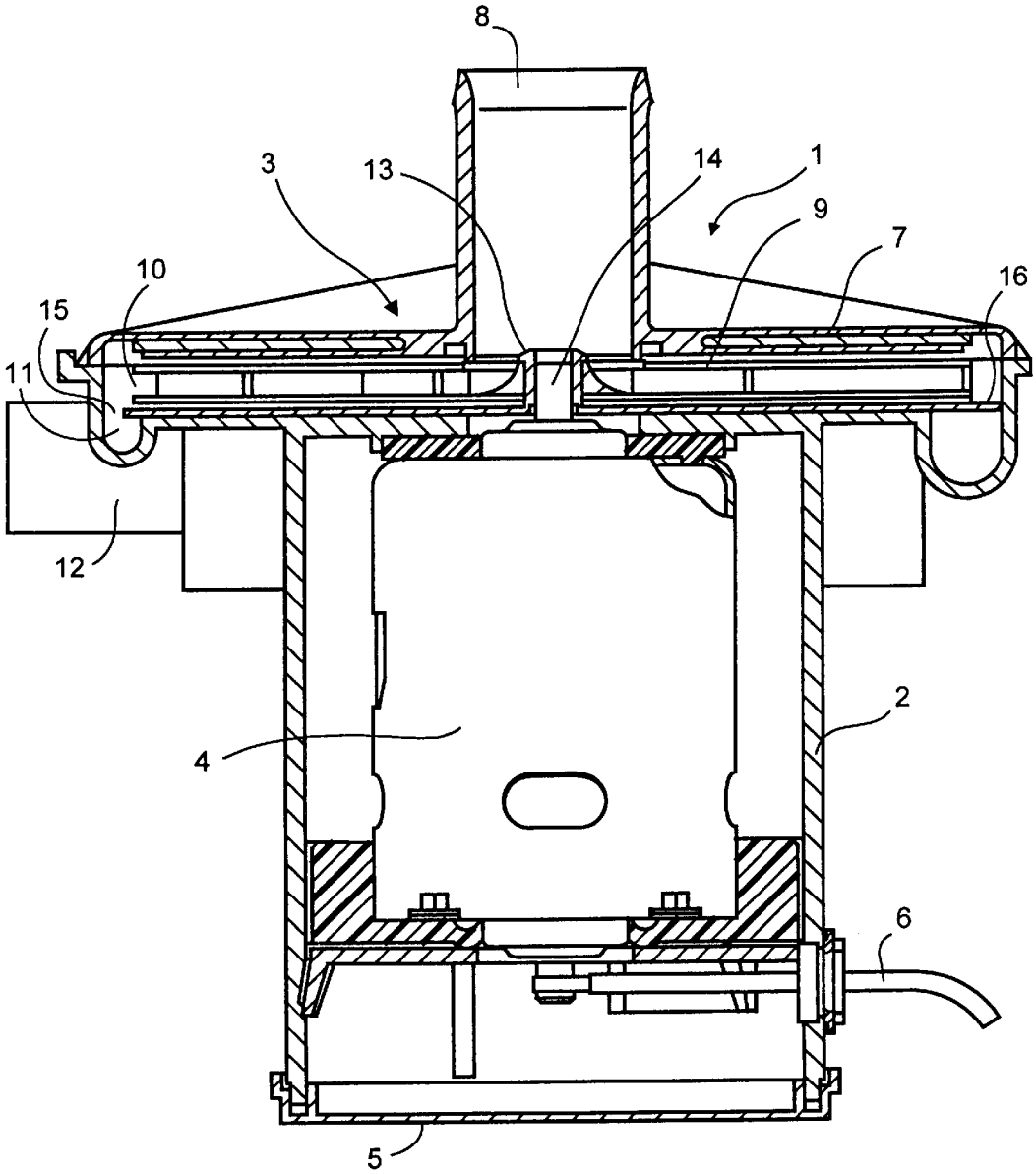
FIG. 1 is a longitudinal sectional side view of a secondary air pump for an internal combustion engine.

FIG. 1 shows an air pump 1 according to the invention which comprises a housing 2 made of plastic material, which receives a pump mechanism 3 on one side of a partition wall and an electric motor 4 on the other side of the partition wall. Housing 2 is sealed on the side of the electric motor by a cover 5. A power supply cable 6 for the electric motor is guided through a side wall of the housing. The housing on the side of the pump mechanism is closed by a cover 7, which has an air inlet 8. By means of an impeller 9, which has radial impeller channels 10, air is transported from the air inlet 8 via channels 10 in the impeller 9 outwardly to an annular channel 11, which opens into an air delivery connection member 12. Impeller 9 has a hub 13 which is attached to a shaft 14 of electric motor 4, which projects into the side of the housing 2 containing pump mechanism 3.

It is provided, according to the invention that annular channel 11 is essentially closed to impeller 9 and has at least one opening 15 for introducing the air from the impeller channels 10 to the annular channel 11. According to the invention, the channel 11 is closed by a cam disk 16 and for introducing the air from impeller channel 10 into channel 11, the opening 15 is formed by a recess 19 at the periphery of the cam disk. The recess 19 is provided with a contour that has specially shaped inlet and outlet profiles 17 and 18. The air which passes through opening 15 is then conducted via the annular channel 11 to the air delivery connection member 12. The annular channel operates as a diffuser due to its continually widening cross-section.

Figure 2:
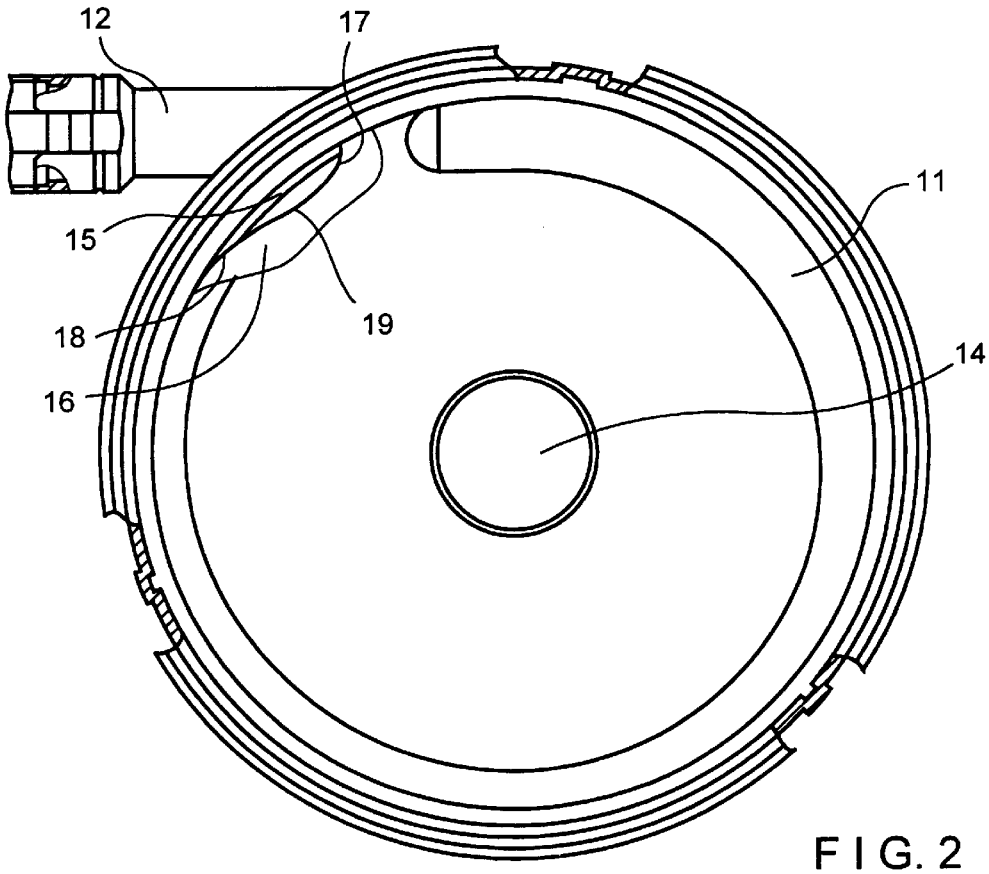
FIG. 2 is a top view of an annular channel of the pump in which a portion of a cam disk is partially broken away.

FIG. 2 shows, in a top view, the annular channel 11, which is covered by the cam disk 16 (of which only the part with recess 19 is shown in the figure). In the present embodiment, recess 19 of disk cam 16 is arranged in such a way that the air inlet from an impeller channel 10 is located most distant from the air delivery connection 12. More specifically as seen in FIG. 2 air is delivered into annular channel 11 from an impeller channel 10 via opening 15 such that the air flows in channel 11 counterclockwise through almost 360° until it reaches the air delivery member 12.

By means of a suitable control means (not shown), cam disk 16 can be rotated in the direction of air delivery connection member 12 during the operation of the pump to change the position of recess 19 and thereby change the magnitude of opening 15 to provide a delay-free adjustment of the pump parameters with respect to pressure and air throughput. The annular channel 11 becomes continually wider in the direction of delivery connection member 12, so that channel 11 acts as a diffuser for the outgoing air. The particular inlet and outlet profiles 17, 18 smooth the air flow through opening 15 from impeller channel 10 into the annular channel 11, so that pressure pulsations are substantially suppressed. As a result, the impeller channels 10, which are not located in the vicinity of recess 19, do not directly participate in the air transport. Thus, a sequential delivery of the air from the individual impeller channels 10 is achieved, which reduces a disadvantageous mutual influencing of the delivery pressure strokes of the different impeller channels 10 on one another to smooth the transported flow of air.

Figure 3:
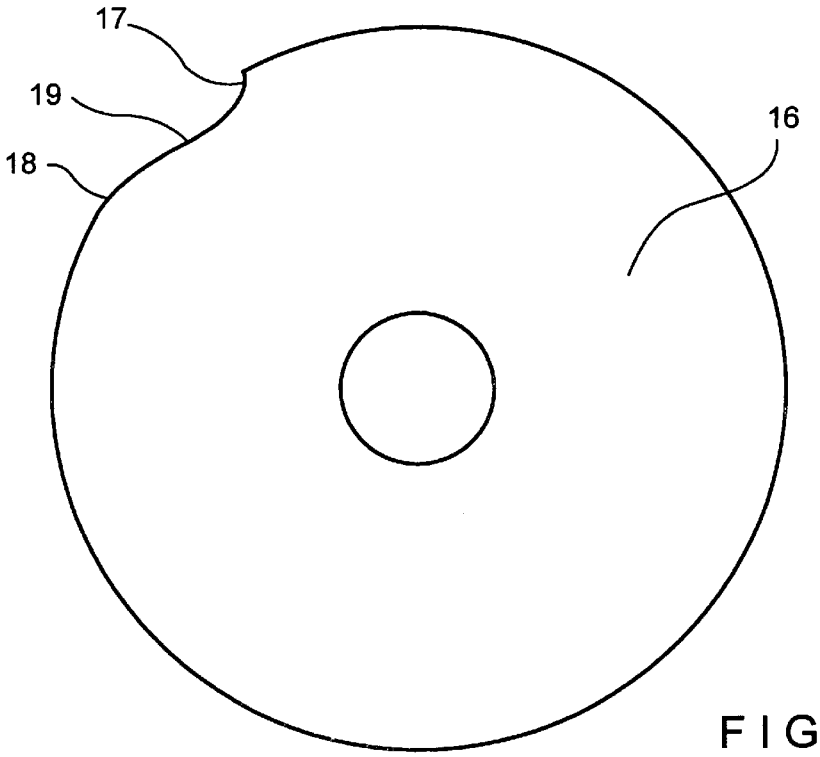
FIG. 3 is a plan view of one embodiment of the cam disk.

FIG. 3 shows a views of the entire cam disk 16 with recess 19.

Although the invention has particularly utility for conveying secondary air in an exhaust system it is clear that other applications are also conceivable, such as, for example, in a turbo-supercharger. Also, any other gases besides air can be utilized instead of air.

What is claimed is:

1. An electrically driven air pump comprising a housing, an electric motor in said housing, a pump mechanism in said housing driven by said electric motor, said pump mechanism including an impeller having impeller channels which convey air to an annular channel for delivery of the air to a discharge connection member, and a member closing flow of air from the impeller channels to said annular channel except for a defined opening controlling flow of air from the impeller channels to the annular channel.

2. An electrically driven air pump as claimed in claim 1, wherein said opening has a contour with defined inlet and outlet profiles to provide smooth flow of air through said opening.

3. An electrically driven air pump as claimed in claim 1, wherein said member which closes the air flow from the impeller channels to the annular channel except for the defined opening comprises a stationary cam disk between the impeller channels and the annular channel, said cam disk having a periphery with a recess forming said defined opening.

4. An electrically driven air pump as claimed in claim 3, wherein said cam disk is secured to said housing for angular adjustment to vary the location of said opening.

5. An electrically driven air pump as claimed in claim 4, wherein a second cam disk can be mounted adjacent to the first can disk, the two cam disks having respective recesses which collectively form said defined opening which can be adjusted in size and contour by relative movement of said two cam disks.

6. An electrically driven air pump as claimed in claim 3, wherein said recess has a length between one and two times the width of one of said impeller channels.

7. An electrically driven air pump as claimed in claim 1, wherein said annular channel has a cross-section which progressively increases in a direction of air flow in said annular channel from said defined opening to said discharge connection member.

8. An electrically driven air pump as claimed in claim 3, wherein said cam disk is positioned so that air flow in said annular channel travels from said defined opening to said discharge connection member through an angle of substantially 360°.

* * * * *